US005499468A

United States Patent [19]

Henry

[11] Patent Number: 5,499,468

[45] Date of Patent: Mar. 19, 1996

[54] IDENTIFICATION BRACELET

[76] Inventor: Jesse E. Henry, P.O. Box 671821, Houston, Tex. 77267-1821

[21] Appl. No.: 296,458

[22] Filed: Aug. 26, 1994

[51] Int. Cl.[6] ..... A44C 5/00

[52] U.S. Cl. ..... 40/633; 40/665; 63/3

[58] Field of Search ..... 40/633, 665, 316; 283/75; 63/3, 21, 24; 24/163 K

[56] References Cited

U.S. PATENT DOCUMENTS

| | | | |
|---|---|---|---|
| 1,578,468 | 3/1926 | Rankin | 24/163 K |
| 2,067,484 | 1/1937 | Freysinger . | |
| 2,449,181 | 9/1948 | Smiley . | |
| 2,573,055 | 10/1951 | Pedersen | 63/3 |
| 2,749,634 | 6/1956 | Billett et al. | 40/633 |
| 2,846,796 | 8/1958 | Polzin . | |
| 3,020,657 | 2/1962 | Clark . | |
| 3,020,658 | 2/1962 | Clark . | |
| 3,631,616 | 1/1972 | Hill | 40/633 |
| 3,800,450 | 4/1974 | Laugherty et al. . | |
| 3,805,427 | 4/1974 | Epstein | 40/633 |
| 3,889,411 | 6/1975 | Laugherty et al. . | |
| 5,323,554 | 6/1994 | MacDonald . | |

FOREIGN PATENT DOCUMENTS

| | | | |
|---|---|---|---|
| 315971 | 10/1956 | Switzerland | 40/633 |

*Primary Examiner*—Peter M. Cuomo
*Assistant Examiner*—James O. Hansen
*Attorney, Agent, or Firm*—Harrison & Egbert

[57] ABSTRACT

An identification bracelet having a bracelet body with a pocket formed on an interior of the body, a closure seal removably affixed to an opening at one end of the bracelet body so as to seal an interior of the pocket in a water-tight condition, and a buckle affixed to one of the ends of the bracelet body so as to detachably connect the ends of the bracelet body together. The pocket has one end opening at one end of the bracelet body and has another end terminating distal an opposite end of the body. An identification information sheet is removably received within the pocket. The identification information sheet is in a folded condition within the pocket. The identification information sheet has identification information affixed to at least one surface thereof. The closure seal is a plug having a portion fitting interior of one end of the pocket and having a second portion in abutment with an end of the bracelet body. The buckle is removably affixed to one end of the body and has a connector member for engaging one of a plurality of holes extending longitudinally from an opposite end of the body toward the pocket.

8 Claims, 2 Drawing Sheets

FIG. 4A

44

*Red Alert System* ™

In case of an accident, medical emergency or death, please alert a member of my family or one of my friends.

Thank You, (signature)_____

| Family | Relationship | Area Code & Number |
|---|---|---|
| | | |

| Friends | Area Code & Number |
|---|---|
| | |

| Employer or Other | Area Code & Number |
|---|---|
| | |

60

FIG. 4B

44

Medical Condition or Current Diagnosis:

Medicine(s) Allergic To:

Prescribed Medicine(s) Presently Taking:
(or Non-prescription)

| Family Doctor(s) | Area Code & Number |
|---|---|
| | |

| Insurance Co. and/or Agent | Area Code & Number |
|---|---|
| | |

Special Request:

62

Thank You Again,

Date:_____ Signature:_____

IDENTIFICATION BRACELET

TECHNICAL FIELD

The present invention relates generally to apparatus for personal identification. More particularly, the present invention relates to bracelets having an area for the receipt of personal and medical identification information.

BACKGROUND ART

Identification bands have been employed in the past in a variety of functions. The most common use for identification bands, in the past, has been in hospitals for the identification of patients. Additionally, such bands have been employed in hospitals to provide identification as to the particular patient.

One of the problems with such identification bands is that they are seldom used to the extent that they are needed. Many times, in the case of missing children, it is very difficult to locate the parents, relatives, or other persons when the child is found. Persons can become involved in automobile accidents or other circumstances in which identification is necessary, but is unavailable. If the person is in a condition in which they cannot verbally communicate the necessary identification, then much of the identifying and medical processing of the person is carried out on a hit-or-miss basis. Many times, improper medical attention is applied to the person because of a lack of necessary identification or medical information.

In the past, various patents have issued that relate to identification bracelets. For example, U.S. Pat. No. 2,449,181, issued on Sep. 14, 1948 to J. R. Smiley describes a non-removable transparent identification band. This band is provided so that it is non-removable from the wrist of the person wearing the band. The band is of a tubular configuration that allows one end of the band to be received within the opposite end of the band.

U.S. Pat. No. 2,846,796, issued on Aug. 12, 1958, to W. J. Polzin teaches an identification band that has an area suitable for the receipt of an identification card therein. The identification-card receiving area is transparent so that the identification can be seen from the exterior of the band. The ends of the band are connected together so that the bracelet is very difficult to remove.

U.S. Pat. Nos. 3,020,657 and 3,020,658, issuing on Feb. 13, 1962, to J. L. Clark describe a hospital identification band that includes a clear portion, on the exterior, upon which the identification information can be received from the exterior of the band. The identification information is included generally centrally of the band. Snaps are provided so as to securely attach one end of the band to the opposite end of the band.

U.S. Pat. No. 3,800,450, issued on Apr. 12, 1974, to L. Laugherty et al. teaches an identification band that comprises an elongated tube of non-elastic material which is transparent. An identification card can be inserted into the tube so as to movable through the wall thereof. A clip is provided which is intended to be permanently closed when the band is applied on an individual. U.S. Pat. No. 3,889,441, issued to the same inventor, on Jun. 17, 1975, teaches a similar configuration.

U.S. Pat. No. 5,323,554, issued on Jun. 28, 1994, to R. D. McDonald describes a tubular identification band having a constant circular cross-section across the majority of its outer circumference. The tube contains an indicia such that the indicia is magnified by the circular shape of the tube. The ends of the tube are plugged into each other.

U.S. Pat. No. 2,067,484, issued on Jan. 12, 1937, to J. B. Freysinger describes a clip-type buckle having a lever with a plurality of gripping teeth for engaging the end of the belt so that the buckle can be removably affixed to the belt.

It is an object of the present invention to provide an identification bracelet that can contain personal and medical identification therein.

It is another object of the present invention to provide an identification bracelet that maintains the identification information in a water-tight condition.

It is another object of the present invention to provide an identification bracelet that is attractive to wear.

It is a further object of the present invention to provide an identification bracelet that is easy to attach and easy to remove.

It is still another object of the present invention to provide an identification bracelet that is relatively inexpensive and easy to manufacture.

These and other objects and advantages of the present invention will become apparent from a reading of the attached specification and appended claims.

SUMMARY OF THE INVENTION

The present invention is an identification bracelet that comprises a bracelet body having a pocket formed on an interior of the body, a closure removably affixed in an opening at one end of the pocket and at one end of the bracelet body, and a buckle affixed to one of the ends of the bracelet body so as to detachably connect the ends of the bracelet body together. The pocket has one end opening at one end of the bracelet body and has an opposite end terminating distal an opposite end of the body.

The bracelet body is a flexible longitudinal member having a length suitable for extending around a human wrist. The bracelet body is made of a generally opaque plastic material. The bracelet body has an inner wall and an outer wall. The pocket is formed between the inner wall and the outer wall. The inner and outer walls are sealed together at the termination of the pocket. Alternatively, the pocket can be slidably received between the inner wall and the outer wall of the bracelet body.

The present invention includes an identification information sheet removably received within the pocket. This identification information sheet is in a folded condition within the pocket. The identification information sheet has identification information applied to at least one surface of the sheet.

The closure is a plug having a first portion fitting interior of one end of the, pocket. The plug also has a second portion that is in abutment with the end of the bracelet body adjacent the end of the pocket. The second portion extends outwardly from the first portion of the plug. The second portion of the plug has a length generally matching a width of the bracelet body. The first portion of the plug extends inwardly of the pocket.

The buckle is removably affixed to one end of the body. The buckle has a connector member for engaging one of a plurality of holes extending longitudinally from the opposite end of the body toward the pocket. The buckle has a lever with gripping teeth formed thereon. These gripping teeth serve to compress one end of the body and to compress this end of the body onto the closure. The buckle also has a signal identifier affixed to an outer surface thereof.

BRIEF DESCRIPTION OF THE DRAWINGS

FIG. 4A is a front view of the identification information sheet of the present invention.

FIG. 4B is a rear view of the identification information sheet of the present invention.

DETAILED DESCRIPTION OF THE INVENTION

Figure 1:
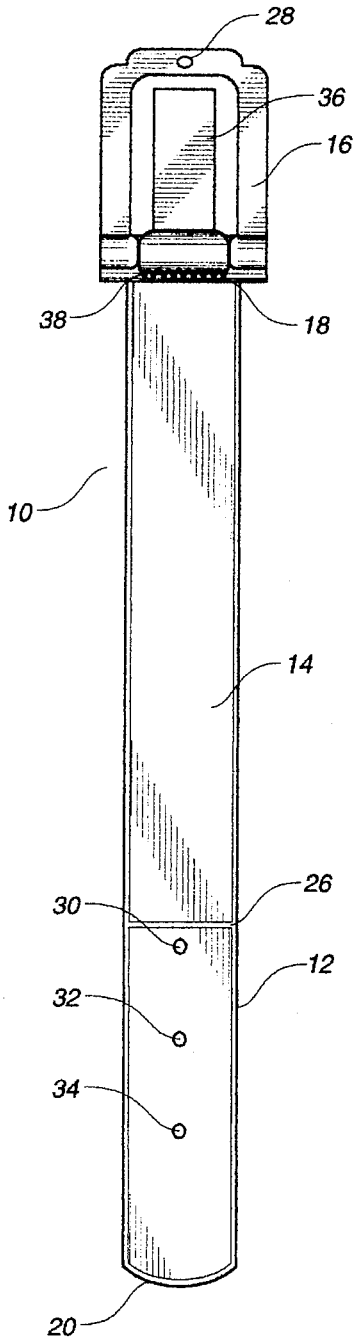
FIG. 1 is a bottom view of the identification bracelet in accordance with the present invention.

Referring to FIG. 1, there is shown at 10 the identification bracelet in accordance with the preferred embodiment of the present invention. The identification bracelet 10 includes a bracelet body 12 having a pocket 14 formed on an interior of the body 12. A buckle 16 is affixed to the bracelet body 12 at one end. The buckle 16 serves to detachably connect one end 18 of the bracelet body 12 to an opposite end 20 of the bracelet body 12.

The bracelet body 12 is a longitudinal member having a length suitable for extending around a given wrist. The bracelet body 12 is made of a generally opaque material. The bracelet body 12 has an inner wall 22 and an outer wall (shown in FIG. 2). The pocket 14 is formed between the inner wall 22 and the outer wall 24. The inner wall 22 and the outer wall 24 are sealed together at the termination 26 of the pocket 14.

It can be seen that the pocket 14 has one end opening at end 18 of the bracelet body 12. The pocket 14 terminates at end 26 generally distal the opposite end 20 of the body 12. As will be described hereinafter, a closure seal is removably affixed to the opening at the end 18 of the bracelet body 12. This closure seal serves to seal an interior of the pocket 14 in a generally water-tight condition.

The buckle 16 is affixed to end 18 of the bracelet body 12. In the preferred embodiment of the present invention, the buckle 16 is removably affixed to the end 18. The buckle 16 has a connector member 28 that can engage one of a plurality of holes 30, 32 or 34. These holes 30, 32 and 34 extend longitudinally from the opposite end 20 of the body 12 toward the pocket 14. In this manner, the bracelet body 12 can be attractively wrapped around a wrist of a person so as to be attached and removed, as necessary. The buckle 16 includes a lever arm 36 having gripping teeth 38 formed thereon. These gripping teeth 38 serve to compress the end 18 of the body 12 so as to facilitate the sealing of this end 18 in a water-tight condition.

Figure 2:
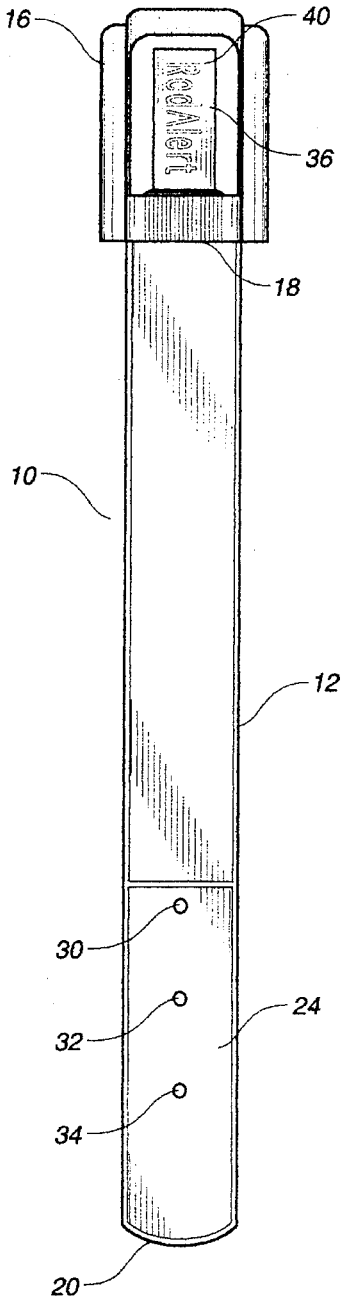
FIG. 2 is a plan view of the identification bracelet in accordance with the present invention.

FIG. 2 shows the plan view of the identification bracelet 10. As can be seen in the plan view of FIG. 2, the identification bracelet 10 has an attractive opaque outer surface. The holes 30, 32 and 34 are provided adjacent to the end 20 so as to connect with the buckle 16 at the end 18 of the body 12. Importantly, it can be seen that the buckle 16 includes a signal identifier 40. The signal identifier can tell any member of the public that the bracelet 10 includes identification information therein. As used herein, the words "RED ALERT (TM)" are imprinted on the lever 36 of buckle 16. Unlike the prior art bracelets, the words "RED ALERT (TM)" provide the public with the necessary information to let the public know that identification information is provided on the interior of the bracelet.

Figure 3:
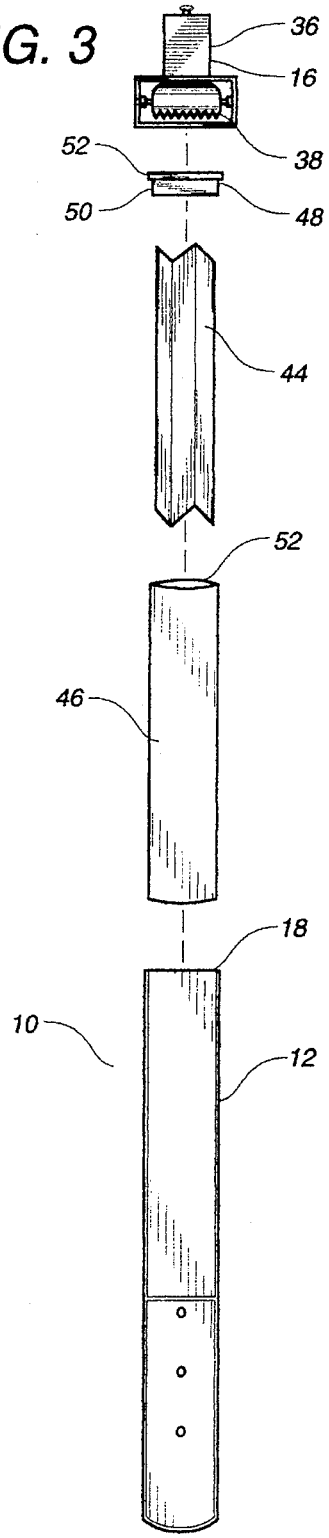
FIG. 3 is an exploded view of the identification bracelet in accordance with the present invention.

FIG. 3 shows the exploded view of the identification bracelet 10. Importantly, it can be seen that an identification information sheet 44 can be removably received within a pocket 46. The pocket 46 can be slidably received within the interior of the bracelet body 12. It should be noted here that the bracelet body 12 can have the pocket 46 integrally formed therein or the pocket 46 can be a separate item which is slidably received within an interior of the bracelet body 12. The identification information sheet is inserted into the pocket 46 in an accordian-style folded condition.

Importantly, it can be seen in FIG. 3 that a closure 48 is affixed at the end 18 of the bracelet body 12. The closure 48 serves to seal an interior of the pocket 46 and the end 18 of the bracelet body 12 in a water-tight condition. The closure 48 is a plug having a first portion 50 that fits interior of the end 52 of the pocket 46. The plug has a second portion 52 that is in abutment with the end surface 18 of the bracelet body 12. As can be seen the second portion 52 extends outwardly and is of a greater diameter than the first portion 50. By inserting the plug 48, the interior of pocket 46 and the interior of the bracelet body 12 are sealed from water intrusion. The buckle 16 fits over the end 18 of the bracelet body 12 (and over the end 52 of pocket 46). When the lever 36 is pushed downwardly, the gripping teeth 38 will cause the end 52 of the pocket 46 to compress onto the first portion 50 of the closure 48. This further facilitates the water-tight seal of the identification bracelet 10.

FIGS. 4A and 4B show the front and back sides of the identification card 44. As can be seen, the identification card 44 has a fairly large size so as to accommodate the necessary identification to properly identify the person, the relatives of the person, and the medical condition of the person wearing the bracelet 10. It can be seen that identification information is imprinted on the front side 60 of the identification information sheet 44. The medical information and insurance information is imprinted on the back side 62 of the identification information sheet 44. The identification information sheet 44 can be conveniently folded, in an accordion fashion, so as to be slidably received within the pocket 46 (or 14) of the bracelet body 12.

The present invention allows the wearer to wear the attractive waterproof band in a convenient fashion. The band can be be worn at all times by every family member. This identification bracelet 10 of the present invention can provide useful information in the event of an accident or a medical emergency, wherever such events should occur. The identification bracelet 10 provides area codes and phone numbers to family and friends that should be alerted in the event of the accident, medical emergency or death. The identification bracelet 10 alerts the medical practitioner of any illness that has been diagnosed or any medicines that can produce an allergic reaction. It also provides the medical practitioner with information as to the prescribed and non-prescription medications that are taken by the person wearing the bracelet 10. The bracelet 10 allows the wearer to list the family doctor and insurance companies or agent's names and phone numbers. The identification card 44 of the identification bracelet 10 has several blank lines in which special requests can be made.

The identification bracelet of the present invention is ideally suited for all persons, especially senior citizens, travelers/vacationers, joggers, commercial drivers, college students, and students of all ages. Persons with medical conditions, such as diabetes, asthma, Alzheimer's disease, epilepsy, hypertension, heart problems, or other life threatening medical conditions should wear this bracelet at all times. Persons involved with hazardous jobs will also find the identification bracelet of the present invention to be a valuable necessity.

Since the present invention contains the identification information within the interior of the bracelet, it avoids the unattractive appearance of prior art identification bracelets. The signal identifier on the buckle of the bracelet alerts all persons to the fact that identification information is contained within the bracelet. There is no need to display the medical information to the public-at-large. The closure allows the medical information to be properly preserved in a water-tight condition. The present invention avoids the need for special imprinting procedures. The bracelet of the present invention can be worn during all activities without fear of water intrusion into the interior of the bracelet.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. An identification bracelet comprising:

a bracelet body having a pocket slidably received between an inner wall and outer wall of said body, said pocket having one end opening at one end of said bracelet body, said pocket terminating between an opposite end and said one end of said body;

a closure seal means removably affixed in said opening at said one end of said bracelet body, said closure seal means for sealing an interior of said pocket in a water-tight condition; and buckle means affixed to one of said ends of said bracelet body, said buckle means for detachably connecting the ends of said bracelet body together.

2. The bracelet of claim 1, said bracelet body being a flexible longitudinal member having a length suitable for extending around a human wrist, said bracelet body being of a generally opaque plastic material.

3. The bracelet of claim 1, further comprising:

an identification information sheet removably received within said pocket.

4. The bracelet of claim 3, said identification information sheet being in a folded condition within said pocket, said identification information sheet having identification information applied to a surface thereof.

5. The bracelet of claim 4, said identification information applied to a front side and to a back side of said identification information sheet.

6. The bracelet of claim 1, said buckle means being removably affixed to said one end of said body, said buckle means having a connector member for engaging one of a plurality of holes extending longitudinally from said opposite end of said body toward said pocket.

7. The bracelet of claim 6, said buckle means having a lever with gripping teeth formed thereon, said gripping teeth for compressing said one end of said body, said buckle means for compressing said one end of said pocket onto said closure seal means.

8. The bracelet of claim 1, said buckle means having a signal identifier affixed onto an outer surface thereof.

* * * * *